United States Patent [19]

Sasaki et al.

[11] Patent Number: 5,022,498

[45] Date of Patent: Jun. 11, 1991

[54] METHOD AND APPARATUS FOR CONTROLLING A GROUP OF ELEVATORS USING FUZZY RULES

[75] Inventors: Kenji Sasaki; Kenji Yokota; Hiroshi Hattori; Nobuyuki Sata, all of Osaka, Japan

[73] Assignee: Fujitec Co., Ltd., Osaka, Japan

[21] Appl. No.: 302,987

[22] Filed: Jan. 30, 1989

[30] Foreign Application Priority Data

Feb. 1, 1988 [JP] Japan ..... 63-21589

[51] Int. Cl.[5] ..... B66B 1/18

[52] U.S. Cl. ..... 187/127; 187/124

[58] Field of Search ..... 187/124, 127, 101

[56] References Cited

U.S. PATENT DOCUMENTS 4,760,896 8/1988 Yamaguchi ..... 187/127

FOREIGN PATENT DOCUMENTS 0023458 3/1978 Japan ..... 187/127
63-17778 1/1988 Japan .
2195792 4/1988 United Kingdom .

OTHER PUBLICATIONS

Yasunobu, a paper, No. JS-41, published and delivered before the 1987 General Assembly of the SICE, Jul. 15-17, 1987, pp. 443-444.

Nikkei Electronics, published Nikkei McGraw-Hill Company, Dec. 28, 1987 issue, No. 437, pp. 50-52.

*TOKKYO* (Patent Law Journal), Nov., 1986, No. 171, pp. 13-20.

A Paper, No. 1537, published and delivered before the 1987 General Assembly of Electric Institute of Japan.

Copy of British Search Report.

*Primary Examiner*—M. H. Paschall

*Attorney, Agent, or Firm*—Sandler, Greenblum & Bernstein

[57] ABSTRACT

The present invention relates to an elevator group control method of controlling a plurality of elevator cars servicing for a plurality of floors, including the steps of applying fuzzy rule groups to a hall call when such a call occurs, and selecting an optimum elevator car with a fuzzy inference applied, and assigning a call to the car. A plurality of fuzzy rule groups are successively applied according to respective priority orders previously given to the fuzzy rule groups. In such successive application, only when there is at least one car, excluding the car whose assignment aptitude is optimum, which has the difference in the assignment aptitude value for the current rule group, from that of an optimum car, of not greater than a predetermined threshold value, a subsequent rule group is applied.

18 Claims, 4 Drawing Sheets

F1L
F1(j)
1
0.9
0

AvG

F1M
F1(j)
1
0.9
0

F2M
F2(j)
1
0.4
0

AG

F1S
F1(j)
1
0.3
0

F2L
F2(j)
1
0.8
0

AvB

Center of Gravity

METHOD AND APPARATUS FOR CONTROLLING A GROUP OF ELEVATORS USING FUZZY RULES

BACKGROUND OF THE INVENTION

1. Field of the Art

The present invention relates to elevator group control method and apparatus.

2. Background of the Art

In elevator group control, assignment control using evaluation functions prevails in this age.

According to such control, each time a hall call occurs, numerical calculations are made for each elevator car with the use of evaluation functions in order to find an optimum elevator car to which such a call is to be assigned. The call is then assigned to the car having the largest or smallest value out of the values thus calculated. According to this method, an advanced group control may be achieved by suitably combining a variety of evaluation functions with the use of parameters.

However, conventional control systems employ constant evaluation functions and parameters. It is therefore difficult for such system to express sophisticated knowledge which experts would use to make a judgment. Accordingly, conventional methods do not always meet the requirements of diversified in-building traffic which varies from time to time.

To achieve a more advanced group control, a proposal has been made of a hall call assignment control by an expert system with the use of fuzzy inference.

In this control method, a variety of evaluation indexes relating to waiting time for a hall call, the probabilities of a long waiting time, the probability of first car arrival, etc., as well as assignment aptitude of car, are expressed in terms of fuzzy variables. Values to such variables are assigned using fuzzy sets: (1) L—(Large), (2) M—(Medium), (3) S—(Small), (4) VG—(Very Good), (5) G—(Good) and (6) VB—(Very Bad). In rule groups, suitable call-assignment methods are expressed in the IF-THEN fuzzy conditional statements. With the use of such rule groups, an optimum car may be selected and assigned based on the degree of conformance of each car for each rule. This control method is now described in more detail in the following.

Consideration is now made on a rule group including the following three rules with the use of evaluation indexes of $F_1$ and $F_2$ only for simplification of the description:

Rule (1)
IF $F_1(j)=L$,
THEN $A(j)=VG$
Rule (2)
IF $F_1(j)=M$ AND $F_2(j)=M$,
THEN $A(j)=G$
Rule (3)
IF $F_1(j)=S$ OR $F_2(j)=L$,
THEN $A(j)=VB$
where $F_1(j)$: Value of the evaluation index $F_1$ when a call is assigned to elevator car j (fuzzy variable)
$F_2(j)$: Value of the evaluation index $F_2$ when a call is assigned to elevator car j (fuzzy variable)
A(j): Assignment aptitude of the elevator car j (fuzzy variable)
L: Large
M: Medium
S: Small
VG: Very good
G: Good
VB: Very bad
AND: Logical product
OR: Logical sum Accordingly, the Rule (1) represents that, when a call is assigned to elevator car j, the assignment aptitude of car j is very good if $F_1$ is large. The Rule (2) represents that, when a call is assigned to car j, the assignment aptitude of car j is good if $F_1$ is medium and $F_2$ is medium. The Rule (3) represents that, when a call is assigned to elevator car j, the assignment aptitude of car j is very bad if $F_1$ is small or $F_2$ is large.

First, the degree of conformance for each rule is obtained for each car. Based on the values thus obtained, a car with the optimum assignment aptitude is selected. The degree of conformance of each car for each rule is obtained from fuzzy variables corresponding to each evaluation index with the use of membership functions shown in FIG. 3.

FIG. 3 (*a*) shows membership functions representing the following fuzzy sets:

$F_{1L}$: $F_1$ is large;
$F_{1M}$: $F_1$ is medium; and
$F_{1S}$: $F_1$ is small.

Likewise, FIG. 3 (*b*) shows membership functions representing the following fuzzy sets:

$F_{2L}$: $F_2$ is large;
$F_{2M}$: $F_2$ is medium; and
$F_{2S}$: $F_2$ is small.

FIG. 3 (*c*) shows membership functions representing the following fuzzy sets:

$A_{VG}$: The assignment aptitude is very good;
$A_G$: The assignment aptitude is good; and
$A_{VB}$: The assignment aptitude is very bad.

FIG. 4 shows procedures of obtaining the assignment aptitude value of an elevator car for the above-stated rules.

For example, when Rule (1) is applied to elevator car j, the degree of conformance thereof is calculated in the following manner.

First, $F_1(j)$, or $F_1$ where a call is tentatively assigned to car j, is calculated. Then, the attribute degree of the $F_1(j)$ thus calculated to the fuzzy set representing that $F_1$ is great, is obtained from the membership function $F_{1L}$. As shown in FIG. 4 (*a*), this degree is 0.9 in this example. Accordingly, the assignment aptitude degree of car j for Rule (1) is obtained by multiplying the function $A_{VG}$ by 0.9, as shown in FIG. 4 (*b*).

Likewise, the degree of conformance of car j for Rule (2) is obtained in the following manner.

Based on the logical product of (i) the attribute degree of $F_1(j)$ to the fuzzy set representing that $F_1$ is medium, i.e., 0.9 as shown in FIG. 4 (*c*), and (ii) the attribute degree of $F_2(j)$ to the fuzzy set representing that $F_2$ is medium, i.e., 0.4 as shown in FIG. 4 (*d*), the smaller value or 0.4 is selected as the degree of conformance. Accordingly, the assignment aptitude degree of car j for Rule (2) is obtained by multiplying the function $A_G$ by 0.4, as shown in FIG. 4 (*e*).

Likewise, the degree of conformance of car j for Rule (3) is obtained in the following manner.

Based on the logical sum of (i) the attribute degree of $F_1(j)$ to the fuzzy set representing that $F_1$ is small, i.e., 0.3 as shown as shown in FIG. 4 (*f*), or (ii) the attribute degree of $F_2(j)$ to the fuzzy set representing that $F_2$ is large, i.e., 0.8 as shown in FIG. 4 (*g*), the greater value or 0.8 is selected as the degree of conformance. Accordingly, the assignment aptitude degree of car j for Rule (3) is obtained by multiplying the function $A_{VG}$ by 0.8, as shown in FIG. 4 (*h*).

As shown in FIG. 4 (*i*), the logical sum of FIG. 4 (*b*), (*e*), and (*h*) represents the assignment aptitude degree of car j for Rules (1) to (3), and the center of gravity of the graph shown in FIG. 4 (*i*) represents the assignment aptitude value of car j to the abovestated rules.

According to the above procedures, the assignment aptitude values of all elevator cars to the rules are obtained. The call is assigned to the car having the best assignment aptitude value (in this example, the car whose center of gravity of the graph in FIG. 4 (*i*) is located at the leftmost position).

According to the call assignment method using the fuzzy inference, the knowledge of experts may be readily incorporated in the control system by suitably setting the membership functions, the contents of the rules and the number of rules. This enables a delicate group control of elevators conforming to requirements of the building.

However, such a call assignment method using the fuzzy inference presents following problems.

For example, when two sets that $F_1$ is large and $F_2$ is large, are used as conditions, the rule may be expressed in the following two manners:

IF $F_1$=L AND $F_2$=L; and

IF $F_1$=L OR $F_2$=L.

When the rule is expressed with the use of AND i.e., logical product, the same evaluation is made for both cases where $F_1$ is large and $F_2$ is small and where $F_1$ and $F_2$ are both small. On the other hand, when the rule is expressed with the use of OR i.e., logical sum, the same evaluation is made for both cases where $F_1$ is large and $F_2$ is small and where $F_1$ and $F_2$ are both large. Thus, there is no difference in evaluation between these cases.

To avoid such a problem, it is required to prepare additional rules of other combinations of $F_1$ with $F_2$. However, increase in the number of evaluation indexes results in increase in the combinations thereof, and it is difficult to express, as rules, all necessary combinations of all evaluation indexes. Further, a failure to write necessary rules may be involved. If a number of rules are prepared, this produces rules for which no evaluation would be required dependent on the status of calls and elevator cars. Even in such case, calculations are made for all rules, resulting in a waste of time.

SUMMARY OF THE INVENTION

To overcome the problems above-mentioned, the present invention is proposed. This invention features a plurality of rule groups (rules are divided into a plurality of groups) where priority orders are preprogrammed respectively. The rule groups are successively applied to elevator cars according to the priority orders. In such application, only when there is at least one car, excluding the car whose assignment aptitude value is optimum, which has the difference in the assignment aptitude value that is obtained from the degree of conformance to the current rule group, from that of an optimum car, of not greater than a predetermined threshold value, a subsequent rule groups is applied.

The apparatus for executing such a group control method comprises:

(1) a knowledge base unit storing a plurality of predetermined rule groups to which priority orders are respectively given;

(2) a rule set selecting unit for successively selecting the rule groups according to the priority orders thereof;

(3) an evaluation index calculation unit for executing calculations of evaluation indexes, based on a traffic information signal, when a hall call occurs;

(4) a fuzzy inference unit for obtaining the degree of conformance of each elevator car for each rule, from evaluation indexes and membership functions, and for obtaining, based on the degree of conformance thus obtained, the assignment aptitude value of each car for each rule group; and (5) an assignment aptitude evaluation unit for advancing, by a single step, the selection operation of the rule set selecting unit at the time only when there is at least one car, excluding the car whose assignment aptitude value is optimum, which has the difference in assignment aptitude value to the current rule group, from that of an optimum car, of not greater than a predetermined threshold value, and for stopping the selection operation of the rule set selecting unit when the differences in assignment aptitude values between a car whose value is optimum and that of all other cars are greater than a predetermined threshold value, thereby to provide an assignment signal for selecting the car whose assignment aptitude value is optimum, and assigning a call to the car.

According to the present invention, priority orders are respectively given to a plurality of rule groups, and the rules are successively applied to elevator cars, starting from the most important or most basic rule. This restrains the operation of unnecessary rule groups, thus improving the operation speed.

Further, the rules are divided into a plurality of groups. This eliminates the use of complicated logical expressions to facilitate the development of the rules.

DETAILED DESCRIPTION OF THE PREFERRED EMBODIMENTS

The following description will discuss an embodiment of the present invention with reference to the attached drawings.

Figure 1:
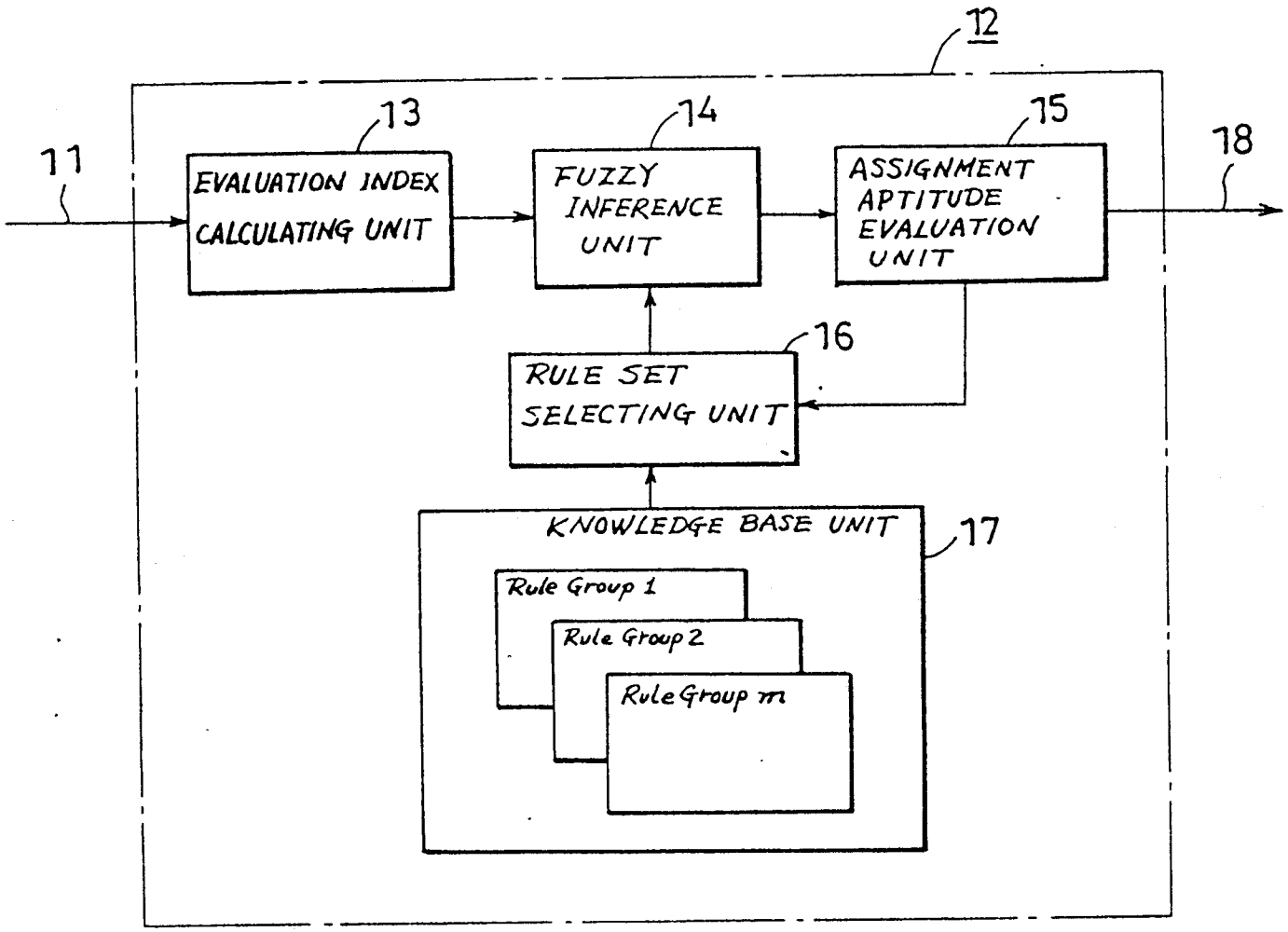
FIG. 1 is a schematic block diagram of an embodiment of group control apparatus in accordance with the present invention.

FIG. 1 shows the arrangement of an embodiment of group control apparatus in accordance with the present invention.

In FIG. 1, a traffic information signal 11 includes a variety of data such as data relating to calls, car positions, and load conditions. An evaluation index calculating unit 13 is adapted to execute calculations of a variety of evaluation indexes based on the traffic information signal 11 when a hall call occurs. In fuzzy inference unit 14, the degree of conformance of each car to each rule is obtained from the evaluation indexes and membership functions, thereby to obtaining the assignment aptitude value of each car for each rule group, as discussed in connection with FIG. 4.

A plurality of rule groups are pre-programmed and stored in the knowledge base unit 17. Priority orders are respectively given to the rule groups. The rule groups having higher priority orders include more basic rules.

An assignment aptitude evaluation unit 15 is adapted to first evaluate the assignment aptitude values of the cars for a first rule group, and then judge whether or not there is at least one car, excluding the car whose assignment aptitude value is optimum, which has the difference in assignment aptitude value, from that of an optimum car, of not greater than a predetermined threshold value. If affirmative, a rule set selection unit 16 is adapted to select a second rule group.

In the fuzzy inference unit 14, the assignment aptitude values of such cars for the second rule group are then obtained. In the assignment aptitude evaluation unit 15, the differences in assignment aptitude values between a car whose value is optimum and other cars is obtained again. When all the differences between said other cars and the car whose value is optimum are greater than a predetermined threshold value, the optimum car is selected. Then, the rule set selection unit 16 stops the selection operation of the subsequent rule groups and provides an assignment signal 18.

Figure 2:
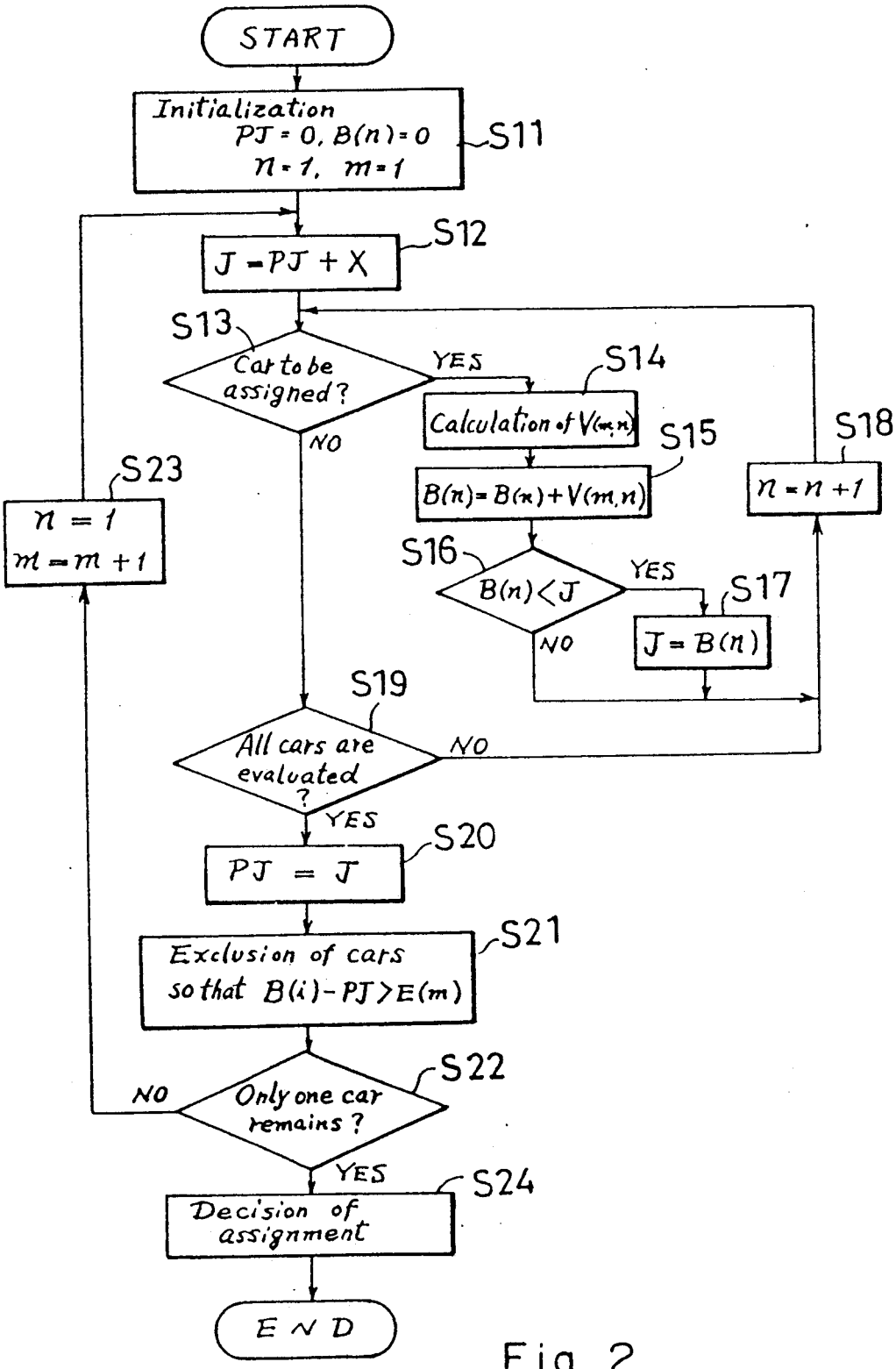
FIG. 2 is a flowchart of a program for assigning a hall call in accordance with the present invention.
Figure 3A:
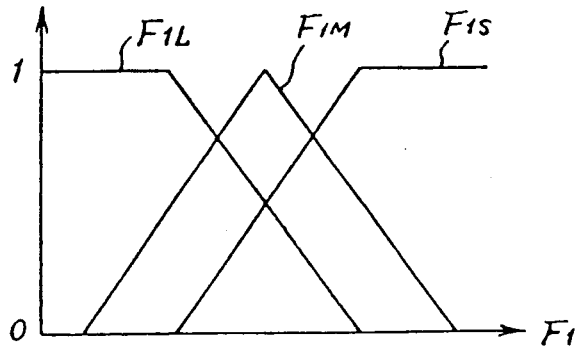
FIG. 3 shows membership functions for illustrating the present invention.
Figure 3B:
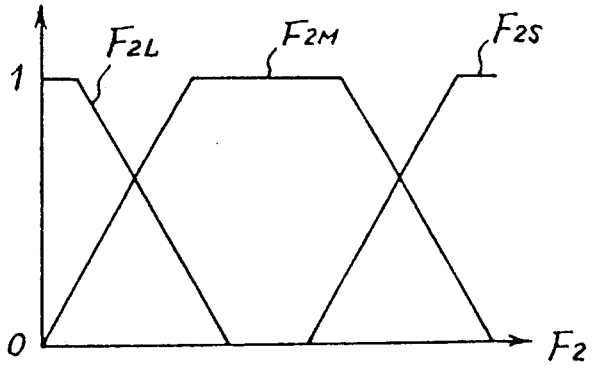
Figure 3C:
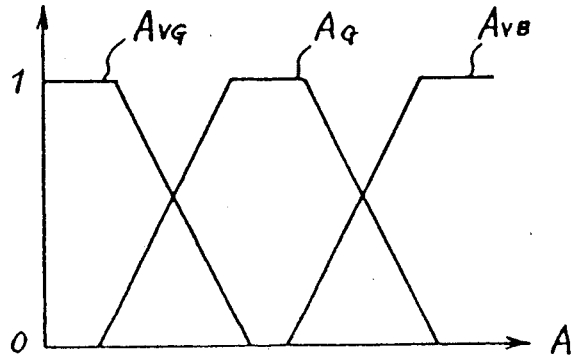

FIG. 2 is a flowchart of an example of a program for assigning a call in accordance with the present invention.

In FIG. 2, the symbols refer to the following meanings, respectively:

n: Variable representing a car No.

m: Variable representing a rule group No.

V (m, n): Evaluation value of a car No. n for a rule group No. m.

B(n): Evaluation value of car No. n.

PJ: Minimum value out of evaluation values of cars for the previous rule group

J: Minimum value out of the evaluation values of cars for the current rule group X: Possible maximum evaluation value E (m): Threshold value for rule group No. m.

Here, the evaluation value refers to an index, with which the assignment aptitude is judged. When the evaluation value is small (great), the assignment aptitude is good (bad).

The following description will discuss the operation of the apparatus of the present invention.

At the step S11, the initialization is made to set all PJ and B (n) to zero, and n and m to 1, respectively.

In step S12, J is set to (PJ+X). Thus, the possible maximum evaluation value is tentatively set to J. In step S13, it is judged whether or not car No. 1 is a car subjected to the assignment of a call. If affirmative, the evaluation value of car No. 1 for rule group No. 1 is calculated in step S14 as described in connection with FIG. 4.

More specifically, the calculation is made to obtain the degrees of assignment aptitude of car No. 1 for all rules of rule group 1. Based on the degrees of assignment aptitude thus obtained, the degree of assignment aptitude of car No. 1 for rule group 1 is obtained. Based on the degree of assignment aptitude thus obtained, the value of assignment aptitude of car No. 1 for the value of rule group 1 is obtained. The value of assignment aptitude thus obtained is then converted into an evaluation value.

Figures 4A, 4B, 4C, 4D, 4E, 4F, 4G, 4H, 4I:
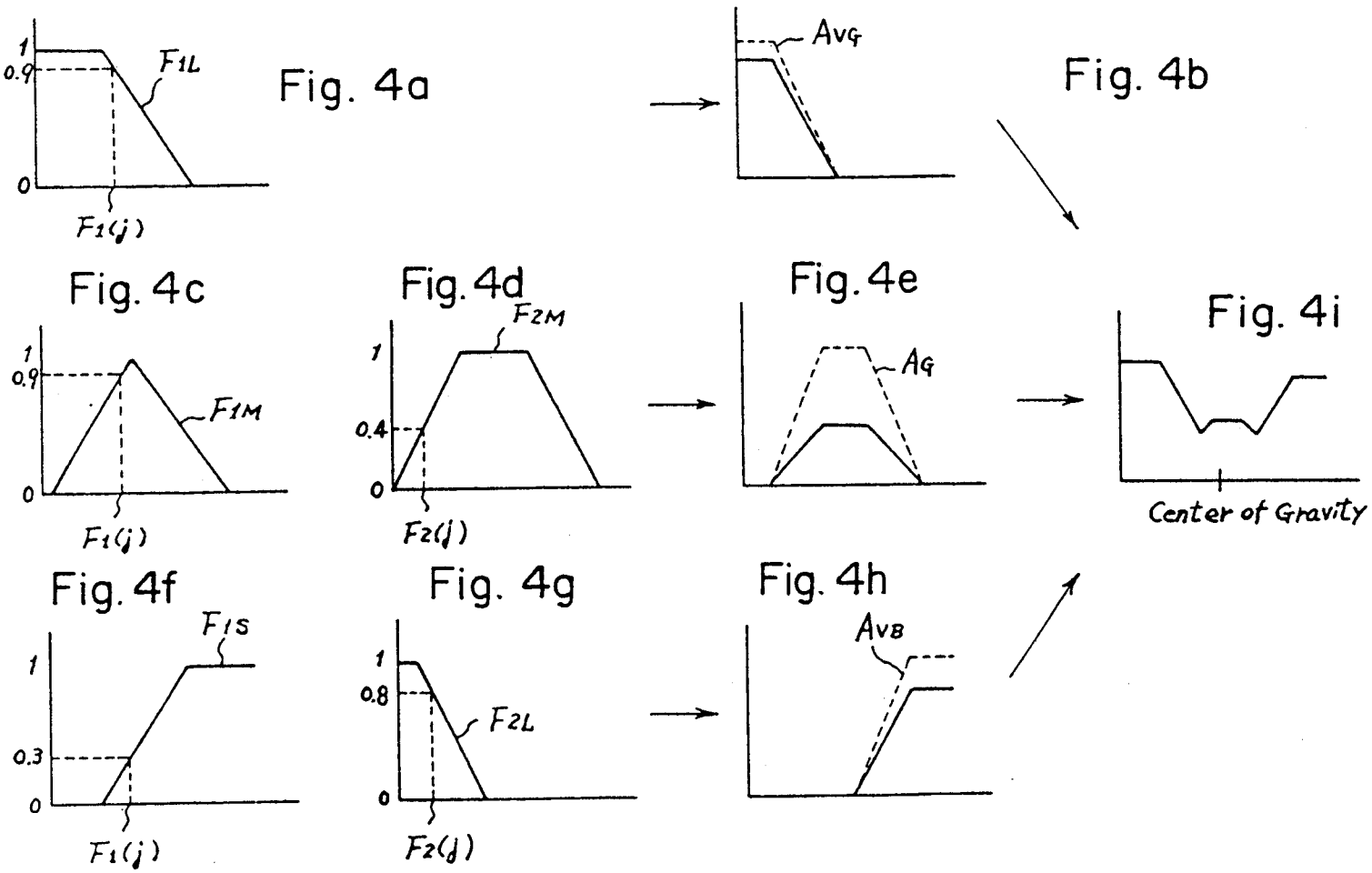
FIG. 4 shows views illustrating an assignment procedure according to fuzzy inference.

In this example, as the assignment aptitude value is greater (smaller), i.e., as the center of gravity approaches a more left-hand (right-hand) position in the graph shown in FIG. 4 (*i*), the evaluation value is smaller (greater).

In step S15, the value obtained by adding the evaluation value for the previous rule group to the evaluation value for the current rule group, is determined to be the total evaluation value for the current rule group. Since the explanation is being made on the first rule group, however, the evaluation value V (1,1) of car No. 1 to rule group 1 is used, as it is, as the evaluation value B (1) of car No. 1.

In step S16, B (1) is compared with J. But, since J has been set to the maximum value at step S12, B (1) is always smaller than J. Accordingly, the sequence proceeds to step S17, where B (1) is set to J as the minimum value. In step S18, n is then set to (n+1). Then, steps S13 to S17 are applied to car No. 2. Likewise, steps S13 to S18 are repeated for all cars subjected to the assignment of a call. Accordingly, the minimum value out of the evaluation values of all cars for the rule group 1 is set to J.

Upon completion of calculations of the evaluation values of the cars for rule group 1, the sequence proceeds from step S19 to S20, where PJ is set to J which is the minimum value out of the evaluation values of the cars for rule group 1.

In step S21, it is checked whether or not the difference between B (i) and PJ is greater than a predetermined threshold value, i.e., whether or not the difference in evaluation value between each car (i=1 to n) and the car having the minimum evaluation value, is greater than a threshold value E (1) which has been predetermined for rule group 1. Each car, of which difference in evaluation value from that of an optimum car is greater than the predetermined threshold value, is regarded as having a bad assignment aptitude, and then excluded from the cars subjected to the assignment of a call, before a judgment is made with the subsequent rule groups to be applied thereto.

When a plurality of cars remain as those that are subjected to the assignment of a call, n is set to 1 and m is set to (m+1) in step S23. Then, the sequence is returned to step S12. This means that calculations are made on the evaluation values of such cars when rule group 2 is applied. As shown in step S15, the evaluation values of cars for rule group 2 are the total evaluation values obtained by adding their evaluation values for rule group 1 to their evaluation values for the rule group 2. Then, in step S21, the cars, of which difference in total evaluation value from the car having the smallest total evaluation value is greater than a threshold value E (2) that has been predetermined for rule group 2, are excluded again from cars subjected to the assignment of a call. Steps S12 to S22 are repeated for the remaining cars. When one car to which a call is assigned finally remains, the sequence proceeds from step S22 to S24, where a decision of the call assignment is made to this car.

As described above, according to the present invention, the rule groups are successively applied according to the priority orders thereof, starting from the rule group having the highest priority. In such successive application, the cars of which evaluation values considerably deviate from the optimum evaluation value, are excluded from the category of call-assignable cars. When only one car subjected to the assignment of a call is left, the subsequent rule groups are no longer applied. The call is thus assigned to this car.

What is claimed is:

1. An elevator group control method for controlling a plurality of elevator cars that service a plurality of floors, in which fuzzy rule groups are applied to a hall call when an elevator call occurs and an optimum elevator car is assigned to proceed to the floor from which the hall call originates based upon the application of the fuzzy rule groups, comprising the step of:

successively applying subsequent fuzzy rule groups to the elevator cars according to priority orders previously assigned to the fuzzy rule groups, in which successive applications of the fuzzy rule groups occurs only when at least one elevator car, excluding the optimum elevator car whose assignment aptitude value is optimum, has a difference in an assignment aptitude value for a current rule group from that of the optimum elevator car, of not more than a predetermined threshold value.

2. The method of claim 1, wherein higher priority orders are given to more important rule groups in view of the elevator call.

3. The method of claim 1, wherein higher priority orders are given to more basic rule groups in view of the elevator call.

4. The method of claim 1, wherein a total assignment aptitude value is obtained by adding the assignment aptitude values of the plurality of elevator cars from a previous rule group to the assignment aptitude values of the elevator cars for the current rule group.

5. The method of claim 1, wherein the predetermined threshold value is set for each rule group.

6. An elevator group control apparatus for controlling a plurality of elevator cars that service a plurality of floors, in which fuzzy rule groups are applied to a hall call when an elevator call is placed and an optimum elevator car is assigned to proceed to a floor from which said hall call originates based upon the application of said fuzzy rule groups, comprising:

a knowledge base unit for storing a plurality of predetermined rule groups to which priority orders are given;

a rule set selection unit for successively selecting rule groups according to said priority orders;

an evaluation index calculation unit for calculating evaluation indexes in response to a traffic information signal when said hall call occurs;

a fuzzy inference unit for obtaining a conformance degree of each elevator car for each rule group based upon said evaluation indexes and a membership function, and for obtaining, based upon said degree of conformance, an assignment aptitude value for each elevator car for each rule group; and an assignment aptitude evaluation unit for single step advancing selection operations of said rule set selecting unit at a time when at least one elevator car, in addition to said optimum elevator car, has an assignment aptitude value for a current rule group that differs from said optimum assignment aptitude value of said optimum elevator car by no more than a predetermined threshold value, and for stopping said selection operation of said rule set selecting unit when the difference in said assignment aptitude value for said current rule group is greater than said predetermined threshold value, thereby providing an assignment signal for selecting an elevator car having an optimum assignment aptitude value, and assigning said elevator car having said optimum assignment aptitude value to proceed to said floor from which said hall call originates.

7. The apparatus of claim 6, wherein higher priority orders are stored in said knowledge base unit for more important rule groups.

8. The apparatus of claim 6, wherein higher priority orders are stored in said knowledge base unit for more basic rule groups.

9. The apparatus of claim 6, wherein a total assignment value is obtained by said fuzzy inference unit by adding the assignment aptitude values for said elevator cars from a previous rule group to assignment aptitude values for said elevator cars of a current rule group.

10. The apparatus of claim 6, wherein said assignment aptitude evaluation unit sets a predetermined threshold value for each rule group.

11. An elevator group control apparatus for determining which elevator car from a plurality of elevator cars should proceed to a floor from which a hall call originates, comprising:

means for storing a plurality of predetermined rule groups to which priority orders are given;

means for selecting rule groups according to said priority orders;

means for calculating indexes in response to a traffic information signal when said hall call occurs;

means for obtaining an assignment aptitude value for each elevator car for each selected rule group so as to determine a degree of conformance of each elevator car for each selected rule group; and means for selecting additional rule groups when an assignment aptitude value of an elevator car for a current rule group differs from an optimum assignment value of an optimum elevator car by no more than a predetermined threshold value.

12. The apparatus of claim 1, further comprising means for stopping said selecting means when the difference in said assignment aptitude value for said current rule group is greater than said predetermined threshold value.

13. The apparatus of claim 11, wherein said storing means comprises a knowledge base unit.

14. The apparatus of claim 11, wherein said assignment aptitude value obtaining means comprises a fuzzy inference unit.

15. The apparatus of claim 11, wherein a total assignment value is obtained by said assignment aptitude value obtaining means by adding the assignment aptitude values for said elevator cars from a previous rule group to assignment aptitude values for said elevator cars of a current rule group.

16. The apparatus of claim 12, wherein said assignment aptitude value obtaining means comprises a fuzzy inference unit, said fuzzy inference unit obtaining a total assignment value adding the assignment aptitude values for said elevator cars from a previous rule group to assignment aptitude values for said elevator cars of a current rule group.

17. The apparatus of claim 11, further comprising means for setting a predetermined threshold value for each rule group.

18. The apparatus of claim 12, further comprising means for setting a predetermined threshold value for each rule group.

* * * * *